US010931044B2

(12) United States Patent
Meng et al.

(10) Patent No.: US 10,931,044 B2
(45) Date of Patent: Feb. 23, 2021

(54) BOARD-TO-BOARD CONNECTOR AND BOARD-TO-BOARD CONNECTOR ASSEMBLY

(71) Applicant: Advanced Connectek Inc., New Taipei (TW)

(72) Inventors: Ta-Teh Meng, New Taipei (TW); Mei Shi, New Taipei (TW); Ya-Ping Liang, New Taipei (TW); Wen-Liang Men, New Taipei (TW); Zheng Li, New Taipei (TW); Ping Shi, New Taipei (TW); Meng Liu, New Taipei (TW); Bo-Wen Xu, New Taipei (TW); Jia-Ying Wu, New Taipei (TW); Hsin-Yu Chang, New Taipei (TW)

(73) Assignee: Advanced Connectek Inc., New Taipei (TW)

( * ) Notice: Subject to any disclaimer, the term of this patent is extended or adjusted under 35 U.S.C. 154(b) by 0 days.

(21) Appl. No.: 16/583,259

(22) Filed: Sep. 26, 2019

(65) Prior Publication Data

US 2020/0136284 A1 Apr. 30, 2020

(30) Foreign Application Priority Data

Oct. 26, 2018 (CN) ..... 201821746035.X

(51) Int. Cl.

| | |
|---|---|
| ***H01R 12/71*** | (2011.01) |
| ***H01R 13/41*** | (2006.01) |
| ***H01R 12/70*** | (2011.01) |

(52) U.S. Cl.

CPC ..... *H01R 12/716* (2013.01); *H01R 13/41* (2013.01); *H01R 12/7052* (2013.01); *H01R 12/712* (2013.01)

(58) Field of Classification Search

CPC .... H01R 12/712; H01R 12/716; H01R 13/41; H01R 12/7052; H01R 13/11

See application file for complete search history.

(56) References Cited

U.S. PATENT DOCUMENTS

| | | | | |
|---|---|---|---|---|
| 10,644,420 | B1 * | 5/2020 | Ishida | H01R 12/712 |
| 2013/0280926 | A1 * | 10/2013 | Ono | H01R 12/7052 439/65 |

FOREIGN PATENT DOCUMENTS

| | | |
|---|---|---|
| CN | 104716506 | 6/2015 |
| TW | M534909 | 1/2017 |

* cited by examiner

*Primary Examiner* — Renee S Luebke
*Assistant Examiner* — Paul D Baillargeon
(74) *Attorney, Agent, or Firm* — JCIPRNET

(57) ABSTRACT

The disclosure relates to a board-to-board connector including a body, multiple terminals and a pair of metal fittings. The body has an accommodating recess. The terminal is disposed on the body and a portion of each of the terminals extends to the accommodating recess. The metal fittings are disposed on the body and beside the accommodating recess. The terminals are located between metal fittings. Each of the metal fittings has at least one limiting portion that extends to the accommodating recess. The limiting portion leans against a corner of the accommodating recess so that the metal fittings and the body generate a two-dimensional limitation. A board-to-board connector assembly is also provided.

24 Claims, 7 Drawing Sheets

BOARD-TO-BOARD CONNECTOR AND BOARD-TO-BOARD CONNECTOR ASSEMBLY

CROSS-REFERENCE TO RELATED APPLICATION

This application claims the priority benefit of China patent application serial no. 201821746035.X, filed on Oct. 26, 2018. The entirety of the above-mentioned patent application is hereby incorporated by reference herein and made a part of the specification.

BACKGROUND

Technical Field

The disclosure relates to a connector, and more particular to a board-to-board connector and a board-to-board connector assembly.

Description of Related Art

A board-to-board connector is used to connect different circuit boards via a receptacle connector and a plug connector being respectively installed on different circuit boards. On mobile devices such as smart phones, the size of the board-to-board connector assembly is very small, which weakens structural strength and reduces the service life of each connector. Furthermore, in some usage environments, in order to facilitate charging or message transmission, the electronic modules in the devices have a large current transmission requirement and the requirements for the specifications of the board-to-board connector will also increase.

As a result, how to improve the structural strength of the board-to-board connector and make it match the relevant specifications under the large current transmission is an issue that the relevant technical personnel need to consider and resolve.

SUMMARY

In view of the above issues, the disclosure provides a board-to-board connector and a board-to-board connector assembly to provide a better structural stability and make it suitable for a large current transmission.

The board-to-board connector of the disclosure includes a body, multiple terminals and a pair of metal fittings. The body has an accommodating recess. The terminals are disposed on the body and a portion of each of the terminals extends to the accommodating recess. The metal fittings are disposed on the body and beside the accommodating recess. The terminals are located between the metal fittings. Each of the metal fittings has at least one limiting portion that extends to the accommodating recess. The limiting portion leans against a corner of the accommodating recess so that the metal fittings and the body generate a two-dimensional limitation.

The board-to-board connector assembly of the disclosure includes a receptacle connector and a plug connector. The receptacle connector includes a first body, multiple first terminals, and a pair of first metal fittings. The first body has the accommodating recess. The first terminals are disposed on the first body. The first metal fittings are disposed on the first body. The first terminals are located between first metal fittings. Each of the first metal fittings has a pair of first conductive portions and a second conductive portion extending to and suspending upon the accommodating recess to form multiple flexible portions. The plug connector includes a second body, multiple second terminals, and a pair of second metal fittings. The second terminals are disposed on the second body. The second metal fittings are disposed on the second body and the second terminals are located between the second metal fittings. Each of the second metal fittings has a pair of third conductive portions and a fourth conductive portion that are fixedly embedded on the outer side surface of the second body. The plug connector and the receptacle connector are adapted to be docked so that the third conductive portions respectively abut and deform a flexible portion of the first conductive portions, and the fourth conductive portion abuts and deforms a flexible portion of the second conductive portion.

In an embodiment of the disclosure, the board-to-board connector is the receptacle connector. The body also has an island structure. The accommodating recess surrounds the island structure. Each of the metal fittings has a pair of limiting portions respectively located in two adjacent corners of the accommodating recess and is corresponding to the island structure across the accommodating recess.

In an embodiment of the disclosure, each of the metal fittings has a side plate and a pair of wing plates extending from the side plate. The limiting portion is located between the side plate and one of the wing plates.

In an embodiment of the disclosure, each of the metal fittings further has a pair of top plates respectively connected between the side plate and the wing plates. The side plate, the top plates and the wing plates are respectively on different planes and the planes are orthogonal to each other.

In an embodiment of the disclosure, the limiting portion extends from the top plates to the accommodating recess and locks the body.

In an embodiment of the disclosure, each of the metal fittings further has a pair of first conductive portions and a second conductive portion, wherein the first conductive portions are on a same axis and opposite to each other, and an orthographic projection of the second conductive portion on the axis is between the first conductive portions.

In an embodiment of the disclosure, the limiting portion is located between the second conductive portion and one of the first conductive portions.

In an embodiment of the disclosure, each of the metal fittings has the side plate and the pair of wing plates extending from the side plate. The first conductive portions respectively extend from the wing plates to the accommodating recess, and the second conductive portion extends from the side plate to the accommodating recess.

In an embodiment of the disclosure, each of the metal fittings further has a pair of top plates respectively connected between the side plate and the wing plates. The limiting portion extends from the top plates to the accommodating recess and locks the body.

In an embodiment of the disclosure, the first conductive portions and the second conductive portion are on a same plane.

In an embodiment of the disclosure, each of the metal fittings has at least one spike for piercing into the body to improve the fixity of the metal fittings and the body.

In an embodiment of the disclosure, each of the metal fittings has the side plate and the pair of wing plates extending from the side plate. The side plate and the wing plates respectively have the spikes to combine the side plate and the wing plates to three adjacent sides of the body.

In an embodiment of the disclosure, the first metal fittings and the second metal fitting each have at least one limiting portion that respectively lean against at least one corner of the first body and the second body.

In an embodiment of the disclosure, the first body further has the island structure. The accommodating recess surrounds the island structure and forms multiple corners. Each of the first metal fittings has a pair of limiting portions respectively located in two adjacent corners of the accommodating recess and relative to the island structure across the accommodating recess.

In an embodiment of the disclosure, the first metal fittings and the second metal fitting respectively have the side plate and the pair of wing plates extending from the side plate. The limiting portion is located between the side plate and one of the wing plates.

In an embodiment of the disclosure, the first metal fittings further have the pair of top plates respectively connected between the side plate and the wing plates. The side plate, the top plates and the wing plates are respectively on different planes and the planes are orthogonal to each other.

In an embodiment of the disclosure, the limiting portion extends from the top plate to the accommodating recess and locks the first body.

In an embodiment of the disclosure, the wing plate forms the third conductive portions and the side plate forms the fourth conductive portion.

In an embodiment of the disclosure, the first conductive portions respectively extend from the wing plate to the accommodating recess and the second conductive portion extends from the side plate to the accommodating recess.

In an embodiment of the disclosure, the first conductive portions and the third conductive portions are on a same axis, the orthographic projections of the second conductive portion and the fourth conductive portion on the axis are located between the first conductive portions and the third conductive portions when the plug connector is docked with the receptacle connector.

In an embodiment of the disclosure, the first conductive portions, the second conductive portion, the third conductive portions and the fourth conductive portion are on a same plane when the plug connector is docked with the receptacle connector.

In an embodiment of the disclosure, each of the first metal fittings has at least one spike for piercing into the body to improve the fixity of the first metal fittings and the first body.

In an embodiment of the disclosure, the pair of the first metal fittings each has a side plate and a pair of wing plates extending from the side plate. The side plate and the pair of wing plates respectively have the spike to combine the side plate and the wing plates to three adjacent sides of the first body.

Based on the above, the board-to-board connector comprises the body, multiple terminals and the pair of metal fittings, wherein the body has the accommodating recess to facilitate docking with another board-to-board connector. Each of the metal fittings is disposed on the body and located beside the accommodating recess, and each of the metal fittings has at least one limiting portion extending to the accommodating recess. By setting and leaning the limiting portion against the corner of the accommodating recess, for the limiting portion, it will substantially lean against the different two inner walls of the accommodating recess so that the metal fittings and the body generate the two-dimensional limitation.

In other words, after the metal fittings are assembled to the body, the structural strength of the assembling of the metal fittings relative to the body may be enhanced via the two-dimensional limitation. Also, the metal fittings may be more stably disposed on the body to effectively improve the structural strength and service life of the board-to-board connector.

Detailed features and advantages of the disclosure are described in the embodiments, which are sufficient to enable any person familiar with the related arts to understand the technical contents of the disclosure and implement them. According to the contents, claims and drawings disclosed by the disclosure, anyone familiar with the related arts can easily understand the purposes and advantages of the disclosure.

DESCRIPTION OF THE EMBODIMENTS

Figure 1:
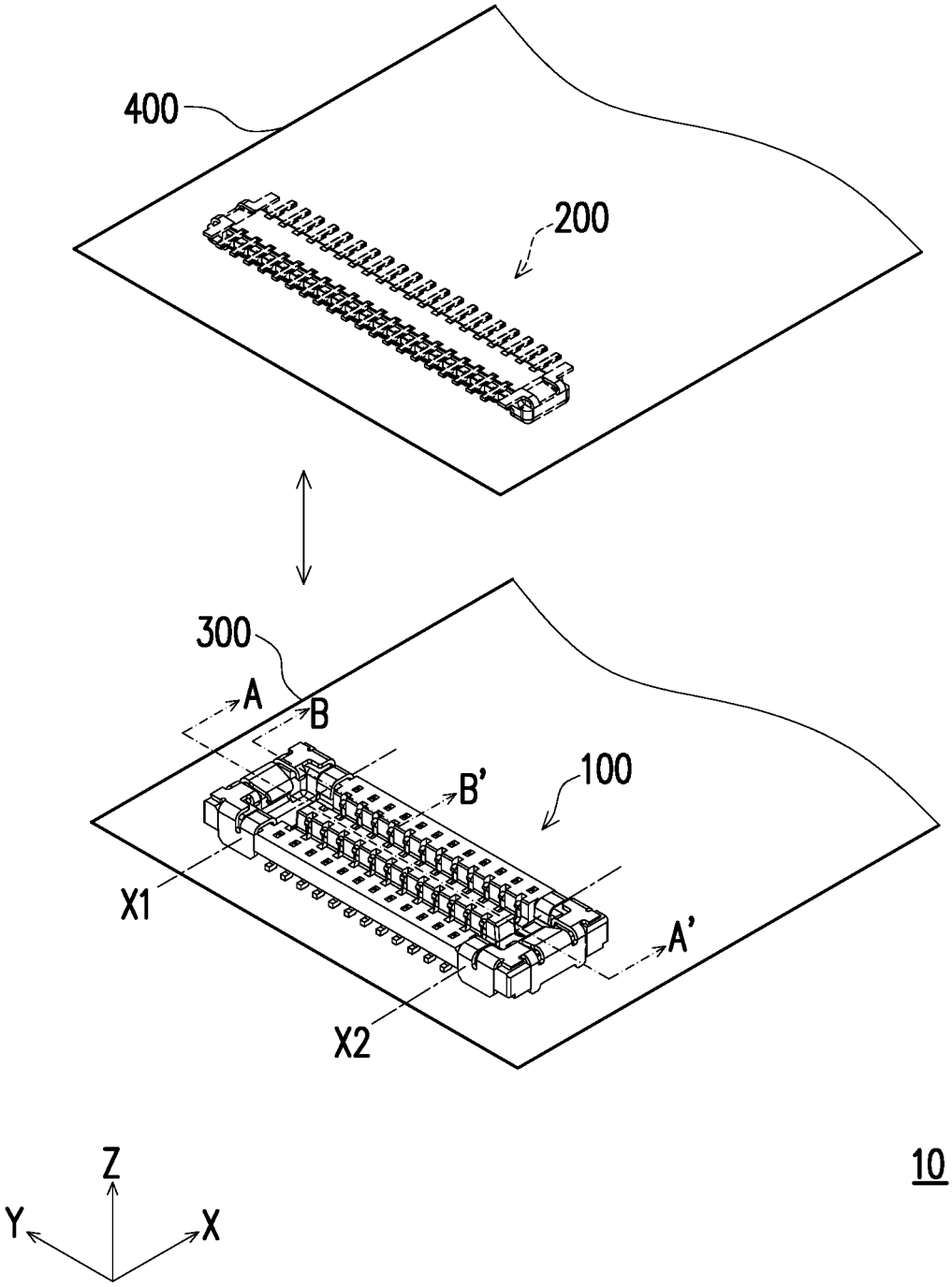
FIG. 1 is a schematic view of assembly of a connector assembly according to an embodiment of the disclosure.
Figure 2:
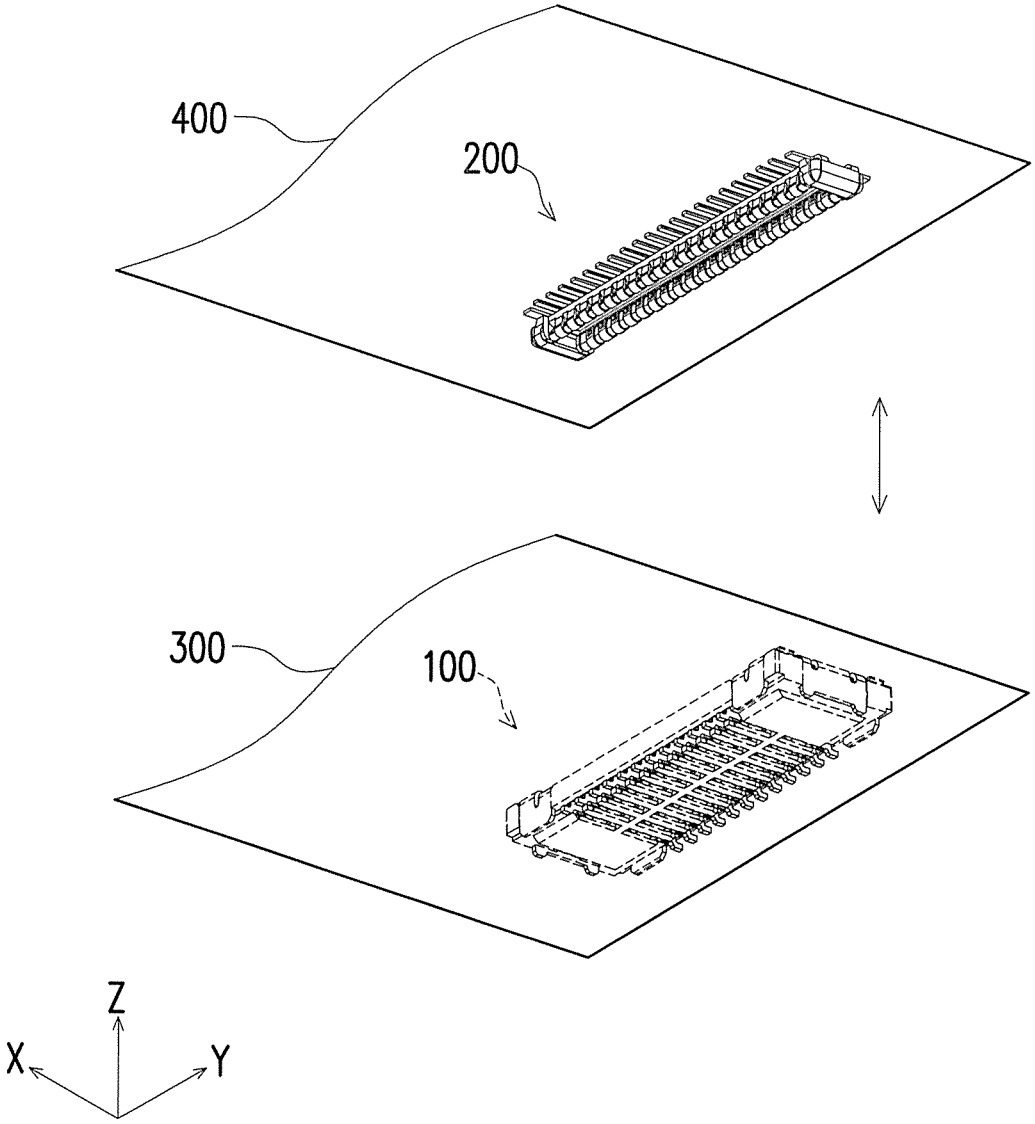
FIG. 2 illustrates the connector assembly of FIG. 1 from another perspective.

FIG. 1 is a schematic view of assembly of a connector assembly according to an embodiment of the disclosure. FIG. 2 illustrates the connector assembly of FIG. 1 from another perspective. Here, an Cartesian coordinate X-Y-Z is provided in the drawing to facilitate the description of a member. With reference to FIG. 1 and FIG. 2, in the embodiment of the disclosure, a connector assembly 10 is a board-to-board connector assembly which includes a receptacle connector 100 and (board to board) a plug connector 200 adapted to be docked to each other (board to board). Here, the receptacle connector 100 is adapted to be disposed on a circuit board 300 (for example, an FPC), and the plug connector 200 is adapted to be disposed on a circuit board 400 (for example, the FPC). The docked receptacle connector 100 and the plug connector 200 are configured to allow different electronic modules (not illustrated) to achieve electrical connection by transmitting electric current, signals and the like via the circuit board 300, the receptacle connector 100, the plug connector 200 and the circuit board 400.

Figure 3:
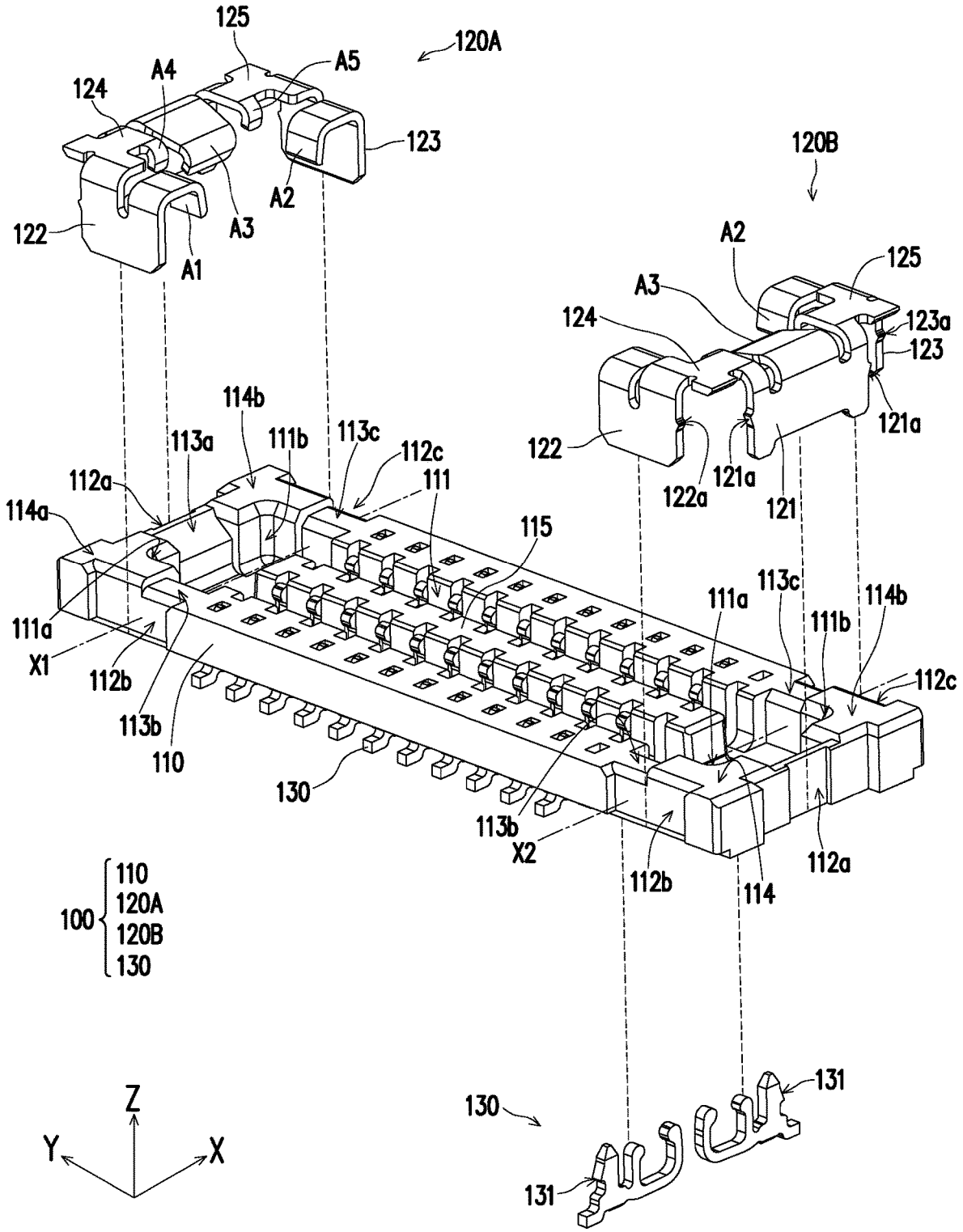
FIG. 3 illustrates an exploded view of a part of members of a receptacle connector of the connector assembly.

FIG. 3 illustrates an exploded view of a part of members of the receptacle connector of the connector assembly. With reference to FIG. 3, in the embodiment of the disclosure, the receptacle connector 100 includes a first body 110 having electrical insulation, multiple first terminals 130 and a pair of first metal fittings 120A and 120B, wherein the first body 110 has an accommodating recess 111 and an island structure 115. The accommodating recess 111 surrounds the island structure 115. The first terminals 130 are disposed on the first body 110 and their contact ends extend from the island structure 115 to the accommodating recess 111 to form a flexible portion. The first metal fittings 120A and 120B are disposed on the first body 110 and are located beside the accommodating recess 111 so that the first terminals 130 are located between the first metal fittings 120A and 120B.

Since the first metal fittings 120A and 120B have the same structure, they are denoted by the same reference numerals. In the embodiment of the disclosure, the first metal fittings 120A and 120B each have limiting portions A4 and A5 that extend to the accommodating recess 111. The limiting portions A4 and A5 lean against corners 111*a* and 111*b* of the accommodating recess 111 so that the first metal fittings 120A and 120B and the first body 110 generate the two-dimensional limitation. As shown in FIG. 3, the accommodating recess 111 surrounds the island structure 115 and forms a rectangular groove so it has corners 111*a* and 111*b*. The limiting portions A4 and A5 are substantially and respectively located in the adjacent two corners 111*a* and 111*b* of the accommodating recess 111 and are corresponding to the island structure 115 across the accommodating recess 111. The first metal fittings 120A and 120B each have a pair of limiting portions A4 and A5. After being assembled to the first body 110, the limiting portion A5 substantially leans against the corner 111*b*, that is, it leans against the two adjacent inner side walls of the accommodating recess 111 at the same time (on the front side in the positive X-axis direction and the left side in the positive Y-axis direction as shown in FIG. 3 based on the Cartesian coordinate X-Y-Z). The limiting portion A4 substantially leans against the corner 111*a*, that is, it leans against two adjacent inner side walls of the accommodating recess 111 at the same time (on the left side of the positive Y-axis direction and the rear side of the negative X-axis direction as shown in FIG. 3 based on the Cartesian coordinate X-Y-Z). Therefore, the first body 110 respectively with the first metal fittings 120A and 120B may each achieve a mutually confined effect on an X-Y plane, that is, the two-dimensional limitation, so that the first metal fittings 120A and 120B can be stably positioned on the first body 110.

In the embodiment of the disclosure, the corner 111*a* of the illustrated accommodating recess 111 is a fillet. However, the embodiment of the disclosure does not limit the type of the corner of the disclosure. In other embodiments that are not shown, the corner may also be a chamfer or a right angle. The limiting portion will change the shape so that it can also abut the structure formed in the corner to achieve the effect of the two-dimensional limitation.

Figure 4:
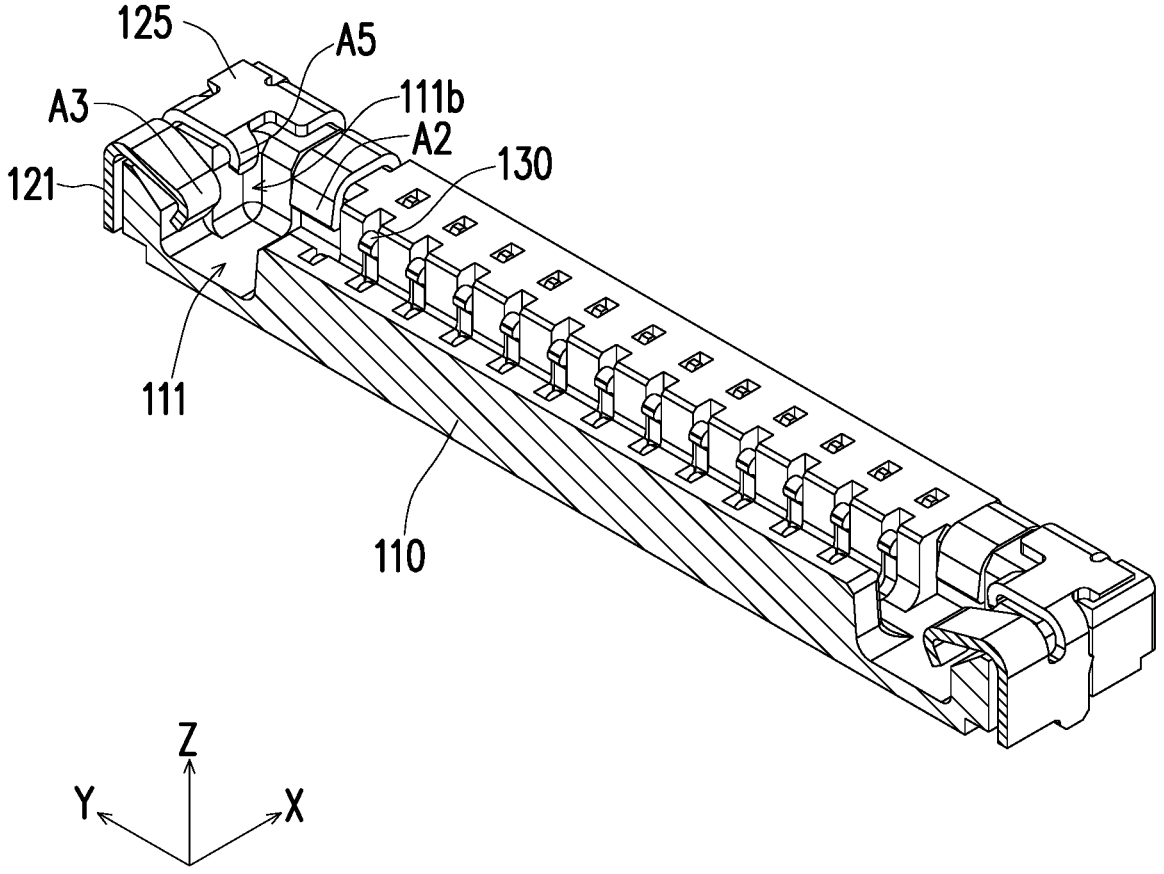
FIG. 4 and FIG. 5 are respectively a local cross-sectional view of the receptacle connector of FIG. 1.
Figure 5:
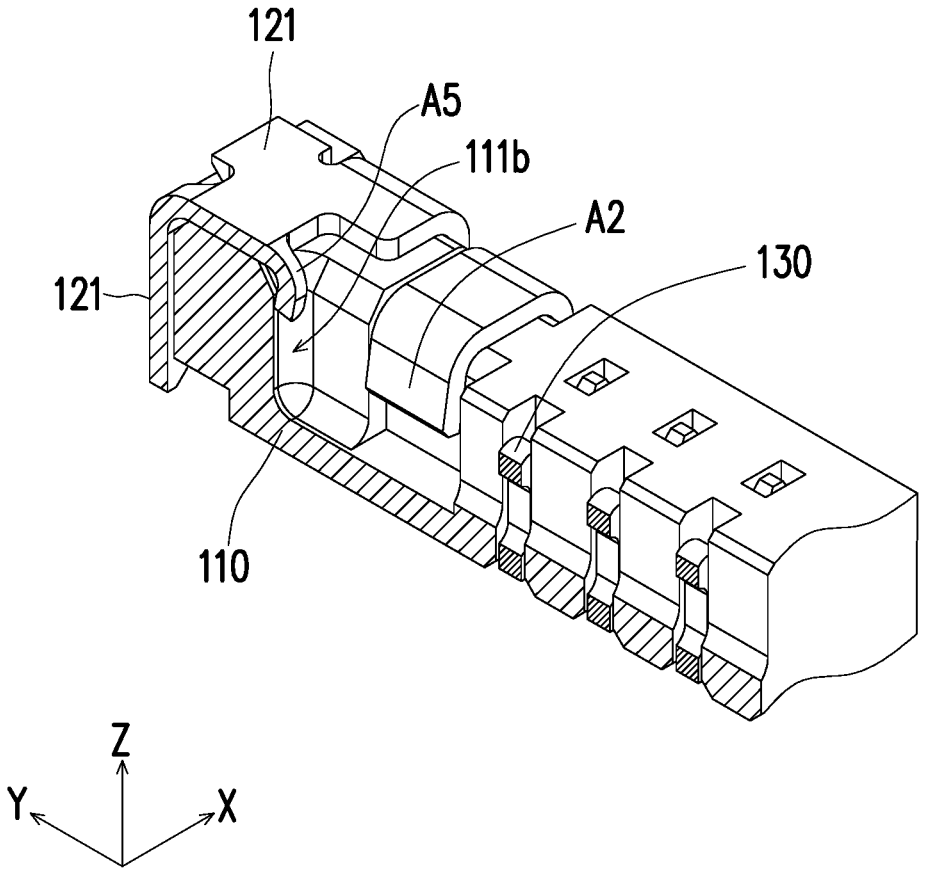

FIG. 4 and FIG. 5 are respectively local cross-sectional views of the receptacle connector of FIG. 1, wherein FIG. 4 is a three-dimensional perspective view of the receptacle connector along a section line A-A', and FIG. 5 is a three-dimensional perspective view of the receptacle connector along a section line B-B'. With reference from FIG. 3 to FIG. 5, in the embodiment of the disclosure, the first metal fittings 120A and 120B have a side plate 121 and a pair of wing plates 122 and 123 extending from the side plate 121. The limiting portion A4 is located between the side plate 121 and the wing plate 122. The limiting portion A5 is located between the side plate 121 and the wing plate 123. Furthermore, the first metal fittings 120A and 120B also have a pair of top plates 124 and 125. The top plate 124 is connected between the side plate 121 and the wing plate 122 and the top plate 125 is connected between the side plate 121 and the wing plate 123. Correspondingly, the first body 110 has outer side recesses 112*a*, 112*b* and 112*c*. When the first metal fittings 120A and 120B are assembled to the first body 110, the side plate 121 is embedded to the outer side recess 112*a* and the wing plates 122 and 123 are respectively embedded to the outer side recesses 112*b* and 112*c* so that the top plates 124 and 125 respectively supported on top surfaces 114*a* and 114*b* of the first body 110. At this time, the limiting portion A4 extends from the top plate 124 to the accommodating recess 111 and locks to the first body 110. The limiting portion A5 extends from the top plate 125 to the accommodating recess 111 and locks to the first body 110.

Of course, the side plate 121 and the wing plates 122 and 123 of the embodiment of the disclosure also match the limiting portions A4 and A5 to improve the two-dimensional limitation effect of the first metal fittings 120A and 120B and the first body 110 on the X-Y plane. Moreover, when the limiting portions A4 and A5 lock a first body 210, it is also possible to effectively prevent the situation of the first metal fittings 120A and 120B being easily to break at the wing plates 122 and 123 because of the expansion of the first body 210 during an insertion and removal of the connector assembly 10.

In the embodiment of the disclosure, the side plate 121, the top plates 124 and 125 and the wing plates 122 and 123 are respectively on different planes and the planes are orthogonal to each other. As shown in FIG. 3, the side plate 121 is located on (and parallel to) an X-Z plane, the top plates 124 and 125 are located on (and parallel to) the X-Y plane, and the wing plates 122 and 123 are located on (and parallel to) a Y-Z plane. Accordingly, the first metal fittings 120A and 120B can be stably positioned on the first body 210.

On the other hand, each of the first metal fittings 120A and 120B has a pair of first conductive portions A1 and A2 and a second conductive portion A3. The first conductive portions A1 and A2 are on the same axis and opposite to each other. (The first conductive portions A1 and A2 of the first metal fitting 120A are located on an axis X1. The first conductive portions A1 and A2 of the first metal fitting 120B are located on an axis X2. The axis X1 and the axis X2 are respectively parallel to the X-axis of the Cartesian coordinate X-Y-Z. An orthographic projection of the second conductive portion A3 on the axis X1 (or the axis X2) is located between the first conductive portions A1 and A2.

Furthermore, as the side plate 121 and the wing plates 122 and 123 are disposed corresponding to the first body 110, the first conductive portions A1 and A2 may be regarded as saddles 113*b* and 113*c* respectively crossing the first body 110 from the wing plates 122 and 123 and extending to the accommodating recess 111. The second conductive portion A3 may be regarded as a saddle 113*a* crossing the first body 110 from the side plate 121 and extending to the accommodating recess 111. The limiting portions A4 and A5 are respectively located between the second conductive portion A3 and the first conductive portions A1 and A2.

It should be noted that in order to increase the current transmission flow when the receptacle connector 100 is docked with the plug connector 200, the first conductive portions A1 and A2 and the second conductive portion A3 of the embodiment of the disclosure are substantially extending to and suspending upon the accommodating recess 111 to form multiple flexible portions. Also, as the first conductive portions A1 and A2 are away from the first body 110, the area thereof exhibits a state of gradually expanding. In addition, unlike the limiting portions A4 which need to be locked to the first body 110, the first conductive portions A1 and A2 of the embodiment of the disclosure are gradually away from the inner side wall of the accommodating recess 111 when extending from the saddles 113*b* and 113*c* to the accommodating recess 111. The second conductive portion A3 is able to maintain the feature of its flexible portion in that the saddle 113*a* is inclined with respect to the X-Y plane. At the same time, the first conductive portions A1 and A2 and the second conductive portion A3 are substantially on the same plane (X-Y plane). This will be further elaborated in the subsequent description of the plug connector 200.

It should be further noted that, with reference again to FIG. 3, in the embodiment of the disclosure, each of the first metal fittings 120A and 120B has at least one spike for piercing into the first body 110 to increase the fixity of the first metal fittings 120A and 120B with the first body 110. Specifically, the side plate 121 and the wing plates 122 and 123 respectively have spikes 121*a*, 122*a* and 123*a*, therefore, the first metal fittings 120A and 120B are inserted into the outer side recesses 112*a*, 112*b* and 112*c* of the first body 110 in a destructive manner via the spikes 121*a*, 122*a* and 123*a* to combine (fix) the side plate 121 and the wing plates 122 and 123 to three adjacent sides of the first body 110. Similarly, the first terminals 130 also have a spike 131 to be inserted into the first body 110 in the destructive manner when they are assembled to the first body 110 to improve the bonding strength between the first terminals 130 and the first body 110.

Figure 6:
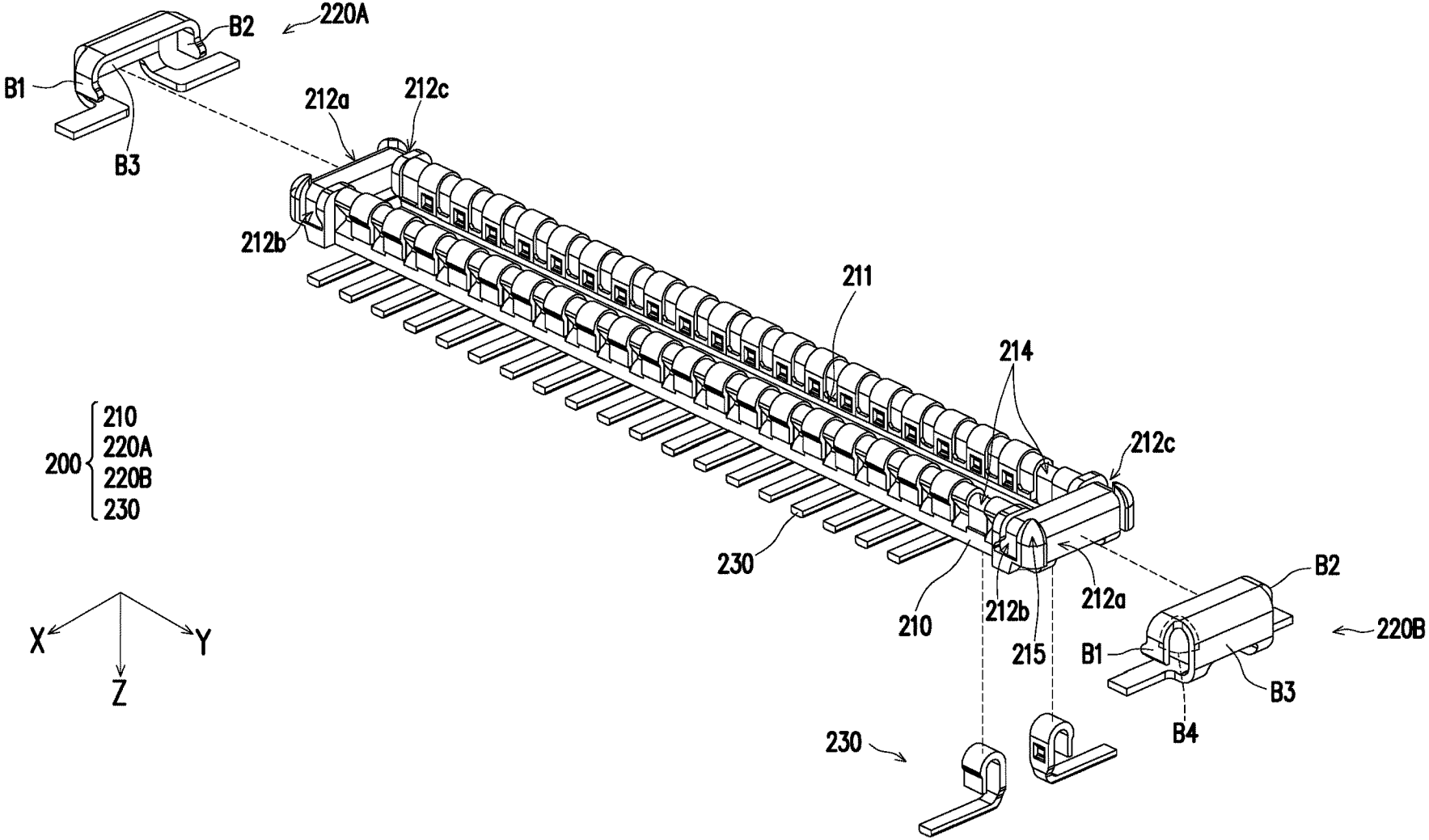
FIG. 6 illustrates an exploded view of a part of members of a plug connector of the connector assembly.

FIG. 6 illustrates an exploded view of a part of members of a plug connector of the connector assembly. The Cartesian coordinate X-Y-Z is shown with reference to FIG. 1 and FIG. 2, and is illustrated from the opposite viewing angle of the receptacle connector 100 to match the status of the two docking with each other. With reference to FIG. 6, in the embodiment of the disclosure, the plug connector 200 includes a second body 210, multiple second terminals 230 and a pair of second metal fittings 220A and 220B. The second terminals 230 are disposed on the second body 210 and are substantially carried by a saddle 214. At the same time, the second terminals 230 extend from a central groove 211 of the second body 210 to become a fixed portion. The second terminals 230 are located between the second metal fittings 220A and 220B to facilitate the island structure 115 be inserted into the central recess 211 when the plug connector 200 and the receptacle connector 100 (as shown in FIG. 3 to FIG. 5) are docked. The saddle 214 of the second body 210 is inserted into the accommodating recess 111, that is, the plug connector 200 and the receptacle connector 100 are embedded with each other so the fixed portion of the second terminals 230 may successfully press and deform a flexible portion of the first terminals 130.

Figure 7:
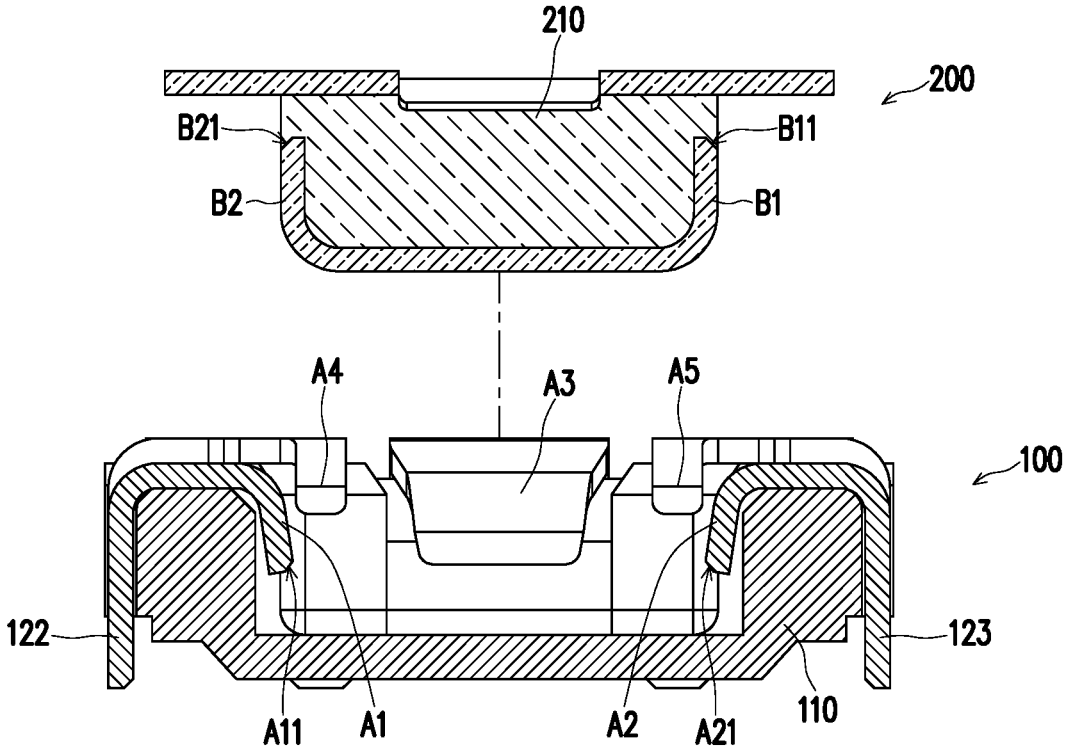
FIG. 7 illustrates a local cross-sectional view of the plug connector and the receptacle connector.

FIG. 7 illustrates a local cross-sectional view of the plug connector and the receptacle connector. With reference to FIG. 6 together with FIG. 7, similar to the first metal fittings 120A and 120B, the second metal fittings 220A and 220B of the embodiment of the disclosure are also identical in structure to each other so are denoted by the same reference numerals. Furthermore, the second metal fittings 220A and 220B each have a pair of third conductive portions B1 and B2 and a fourth conductive portion B3 fixedly embedded on the outer side surface of the second body 210, that is, outer side grooves 212*a*, 212*b* and 212*c* adjacent to the second body 210. Here, there is an anti-slope between the third conductive portions B1 and B2 and the outer side grooves 212*a* and 212*b* along a Z-axis (also along a Y axis). Therefore, after the second metal fittings 220A and 220B are assembled to the second body 210, the second metal fittings 220A and 220B may be prevented from being ejected from the second body 210 and falling off via the anti-slope.

However, unlike the receptacle connector 100, the third conductive portions B1 and B2 and the fourth conductive portion B3 are fixed portions with respect to the second body 210. That is, the third conductive portions B1 and B2 and the fourth conductive portion B3 are integrated with the second body 210 to be a rigid (without elastic) structure. According to this, when the plug connector 200 and the receptor connector 100 are docked with each other, the third conductive portions B1 and B2 which are served as the fixed portions are respectively abutted and deform the first conductive portions A1 and A2 which are served as the flexible portions. The fourth conductive portion B3 is abutted and deforms the second conductive portion A3 which are served as the flexible portion. As shown in FIG. 7, the contact surfaces B11 and B21 of the third conductive portions B1 and B2 are configured to abut the contact surfaces A21 and A11 of the first conductive portions A2 and A1 and to deform the first conductive portions A2 and A1. At this time, the first conductive portions A1 and A2 and the third conductive portions B1 and B2 are located on the same axis (axis X1 and X2). The orthographic projections of the second conductive portion A3 and the fourth conductive portion B3 on the axis (axis X1 and X2) are located between the first conductive portions A1 and A2 and the third conductive portions B1 and B2. The first conductive portions A1 and A2, the second conductive portion A3, the third conductive portions B1 and B2 and the fourth conductive portion B3 are located on the same plane (X-Y plane).

Accordingly, the first metal fittings 120A and 120B of the receptacle connector 100 have the first conductive portions A2 and A1 and the second conductive portion A3. The second metal fittings 220A and 220B of the plug connector 200 have the third conductive portions B1 and B2 and the fourth conductive portion B3. Therefore, when the two are docked, the electrical contact area of the receptor connector 100 and the plug connector 200 may be improved by the mutual abutment of these conductive portions above. That is to say, when the connector assembly 10 is faced with a large current transmission environment, the connector assembly 10 may still successfully match the required specifications and be used. Also, the connector assembly 10 of the embodiment of the disclosure may be applied even if it is not required to face the above usage environment. Therefore, the receptacle connector 100, the plug connector 200 and the connector assembly 10 have a better range of application. At the same time, by replacing the materials of the first metal fittings 120A and 120B and the second metal fittings 220A and 220B, the connector assembly 10 may be adapted to different transmission currents and signals.

In the embodiment of the disclosure, the second metal fittings 220A and 220B each have a limiting portion B4 respectively leans against a corner 215 of the second body 210. As shown in FIG. 6, the second metal fittings 220A and 220B each include a side plate and the pair of wing plates. The side plate is the fourth conductive portion B3, and the wing plates are the third conductive portions B1 and B2. The limiting portion B4 is, for example, a hollow portion between the side plate and the wing plates (that is, between the third conductive portion B1 and the fourth conductive portion B3) and is mutually embedded with the corner 215 which has a convex structure on the second body 210 to generate the two-dimensional limitation. That is, making the second metal fittings 220A and 220B and the second body 210 has a limiting effect on the X-Y plane to facilitate the second metal fittings 220A and 220B to be stably combined with the second body 210.

Based on the above, in the above embodiment of the disclosure, the board-to-board connector comprises the body, multiple terminals and a pair of metal fittings, wherein the body has the accommodating recess to facilitate the docking with another board-to -board connector. Each metal fitting is disposed on the body and located beside the accommodating recess. Also, each metal fitting has at least one limiting portion extending to the accommodating recess. By setting and leaning the limiting portion against the corner of the accommodating recess, for the limiting portion, it will substantially lean against the different inner walls of the accommodating recess so that the two-dimensional limit is generated between the metal fittings and the body.

In other words, after the metal fittings are assembled to the body, by the two-dimensional limit being created via the limiting portion and the accommodating recess, the structural strength of assembling of the metal fittings relative to the body may be enhanced. Also, the metal fittings may be more stably disposed on the body to prevent the metal fittings from falling off or even breaking during the insertion and removal so as to effectively improve the structural strength and service life of the board-to-board connector.

What is claimed is:

1. A board-to-board connector, comprising:

a body having an accommodating recess;

a plurality of terminals disposed on the body, a portion of each of the terminals extending to the accommodating recess; and a pair of metal fittings disposed on the body and located beside the accommodating recess with the terminals located between the pair of metal fittings, each of the metal fittings having at least one limiting portion extending to the accommodating recess, wherein the limiting portion leans against a corner defined by two adjacent inner side walls of the accommodating recess, and the limiting portion leans against the two adjacent inner side walls of the accommodating recess at the same time, so that the metal fittings and the body generate a two-dimensional limitation.

2. The board-to-board connector according to claim 1, wherein the board-to-board connector is a receptacle connector, the body further has an island structure, the accommodating recess surrounds the island structure, and each of the metal fittings has a pair of limiting portions respectively located in two adjacent corners of the accommodating recess and corresponding to the island structure across the accommodating recess.

3. The board-to-board connector according to claim 1, wherein each of the metal fittings has a side plate and a pair of wing plates extending from the side plate, and the limiting portion is located between the side plate and one of the wing plates.

4. The board-to-board connector according to claim 3, wherein each of the metal fittings further has a pair of top plates, the pair of top plates are respectively connected between the side plate and the pair of wing plates, the side plate, the pair of top plates and the pair of wing plates are respectively on different planes, and the planes are orthogonal to each other.

5. The board-to-board connector according to claim 4, wherein the limiting portion extends from the top plates to the accommodating recess and locks the body.

6. The board-to-board connector according to claim 1, wherein each of the metal fittings further has a pair of first conductive portions and a second conductive portion, wherein the pair of first conductive portions are on a same axis and opposite to each other, and an orthographic projection of the second conductive portion on the axis is between the pair of first conductive portions.

7. The board-to-board connector according to claim 6, wherein the limiting portion is between the second conductive portion and one of the first conductive portions.

8. The board-to-board connector according to claim 6, wherein each of the metal fittings has a side plate and a pair of wing plates extending from the side plate, the pair of first conductive portions respectively extend from the pair of wing plates to the accommodating recess, and the second conductive portion extends from the side plate to the accommodating recess.

9. The board-to-board connector according to claim 8, wherein each of the metal fittings further has a pair of top plates, the pair of top plates are respectively connected between the side plate and the pair of wing plates, and the limiting portion extends from the top plate to the accommodating recess and locks the body.

10. The board-to-board connector according to claim 6, wherein the pair of first conductive portions and the second conductive portion are on a same plane.

11. The board-to-board connector according to claim 1, wherein each of the metal fittings has at least one spike for piercing into the body to improve the fixity of the metal fittings and the body.

12. The board-to-board connector according to claim 11, wherein each of the metal fittings has a side plate and a pair of wing plates extending from the side plate, and the side plate and the pair of wing plates respectively have the at least one spike to combine the side plate and the pair of wing plates to three adjacent sides of the body.

13. A board-to-board connector assembly, comprising:

a receptacle connector, comprising:

a first body having an accommodating recess;

a plurality of first terminals disposed on the first body;

a pair of first metal fittings disposed on the first body with the first terminals located between the pair of first metal fittings, wherein each of the first metal fittings has a pair of first conductive portions and a second conductive portion extending to and suspending upon the accommodating recess to form a plurality of flexible portions, wherein each of the first metal fittings has at least one limiting portion leaning against two adjacent inner side walls of the accommodating recess at the same time;

a plug connector, comprising:

a second body;

a plurality of second terminals disposed on the second body; and a pair of second metal fittings disposed on the second body with the second terminals located between the pair of second metal fittings, wherein each of the second metal fittings has a pair of third conductive portions and a fourth conductive portion fixedly embedded on an outer side surface of the second body, wherein the plug connector is adapted to be docked with the receptacle connector so that the pair of third conductive portions may respectively abut and deform the flexible portions of the first conductive portions, and the fourth conductive portion may abut and deform the flexible portions of the second conductive portion.

14. The board-to-board connector assembly according to claim 13, wherein the pair of second metal fittings each has at least one limiting portion, and the at least one limiting portion of each of the pair of first metal fittings and the pair of second metal fittings respectively leaning against at least one corner of the first body and at least one corner of the second body.

15. The board-to-board connector assembly according to claim 14, wherein the first body further has an island structure, the accommodating recess surrounds the island structure and forms a plurality of corners, and each of the first metal fittings has a pair of limiting portions respectively located in two adjacent corners of the accommodating recess and corresponding to the island structure across the accommodating recess.

16. The board-to-board connector assembly according to claim 14, wherein the first metal fittings and the pair of second metal fittings respectively have a side plate and a pair of wing plates extending from the side plate, and each respective at least one limiting portion is located between the side plate and one of the wing plates.

17. The board-to-board connector assembly according to claim 16, wherein the first metal fittings further have a pair of top plates, the pair of top plates are respectively connected between the side plate and the pair of wing plates, the side plate, the pair of top plates and the pair of wing plates are respectively on different planes, and the planes are orthogonal to each other.

18. The board-to-board connector assembly according to claim 17, wherein the at least one limiting portion extends from the top plates to the accommodating recess and locks the first body.

19. The board-to-board connector assembly according to claim 16, wherein the pair of wing plates of the pair of second metal fittings form the pair of third conductive portions, and the side plate of the pair of second metal fittings forms the fourth conductive portion.

20. The board-to-board connector assembly according to claim 16, wherein the pair of first conductive portions respectively extend from the pair of wing plates of the first metal fittings to the accommodating recess, and the second conductive portion extends from the side plate of the first metal fittings to the accommodating recess.

21. The board-to-board connector assembly according to claim 13, wherein the first conductive portion and the pair of third conductive portions are on a same axis, and orthographic projections of the second conductive portion and the fourth conductive portion on the axis are located between the pair of first conductive portions and the pair of third conductive portions when the plug connector is docked with the receptacle connector.

22. The board-to-board connector assembly according to claim 13, wherein the pair of first conductive portions, the second conductive portion, the pair of third conductive portions and the fourth conductive portion are on a same plane when the plug connector is docked with the receptacle connector.

23. The board-to-board connector assembly according to claim 13, wherein each of the first metal fittings has at least one spike for piercing into the first body to increase the fixity of the first metal fittings and the first body.

24. The board-to-board connector assembly according to claim 23, wherein the pair of the first metal fitting each has a side plate and a pair of wing plates extending from the side plate, and the side plate and the pair of wing plates respectively have at least one spike to combine the side plate and the pair of wing plates to three adjacent sides of the first body.

* * * * *